US011224259B2

(12) United States Patent
Schmidt et al.

(10) Patent No.: US 11,224,259 B2
(45) Date of Patent: Jan. 18, 2022

(54) HELMET WITH FACEGUARD SYSTEM

(71) Applicant: Rawlings Sporting Goods Company, Inc., St. Louis, MO (US)

(72) Inventors: Marc Schmidt, Weldon Spring, MO (US); Zach Runzo, Lake Saint Louis, MO (US); Anton Sutovsky, O'Fallon, MO (US); Michael Kennedy, O'Fallon, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 393 days.

(21) Appl. No.: 15/670,103

(22) Filed: Aug. 7, 2017

(65) Prior Publication Data

US 2019/0037957 A1 Feb. 7, 2019

(51) Int. Cl.
*A42B 3/20* (2006.01)
*A63B 71/10* (2006.01)

(52) U.S. Cl.
CPC ..... *A42B 3/20* (2013.01); *A63B 71/10* (2013.01)

(58) Field of Classification Search
CPC ... A41D 13/00; A41D 13/0005; A41D 13/015
See application file for complete search history.

(56) References Cited

U.S. PATENT DOCUMENTS 2,867,812 A * 1/1959 Roth ..... A42B 3/288 2/6.2
2,908,911 A * 10/1959 Sowle ..... A42B 3/20 2/9
3,864,756 A * 2/1975 Desimone ..... A42B 3/166 2/423
4,114,197 A * 9/1978 Morton ..... A42B 3/16 2/423
4,220,301 A * 9/1980 Jacobs ..... A42B 3/20 2/9
4,233,687 A * 11/1980 Lancellotti ..... A42B 3/20 2/424
4,390,995 A * 7/1983 Walck ..... A42B 3/20 2/9
4,633,531 A * 1/1987 Nimmons ..... A42B 3/20 2/424
4,774,729 A * 10/1988 Coates ..... A42B 3/20 2/424
4,837,866 A * 6/1989 Rector ..... A42B 3/20 2/424
4,885,807 A * 12/1989 Snow, Jr. ..... A42B 3/20 2/424

(Continued)

*Primary Examiner* — Jocelyn Bravo

(57) ABSTRACT

A helmet comprising a shell, a wire guard, at least one spacer, and at least one fastener. The shell has at least one attachment portion which includes an outer surface. The wire guard has at least one attachment portion corresponding to the at least one attachment portion of the shell. The attachment portion of the wire guard includes an inner surface. Each spacer has an outer surface corresponding to the inner surface of a the attachment portion of the wire guard. Each spacer also has an inner surface corresponding to the outer surface of the attachment portion of the shell. The at least one fastener engages each spacer with the corresponding attachment portions of the shell and wire guard.

3 Claims, 5 Drawing Sheets

(56) References Cited

U.S. PATENT DOCUMENTS 4,887,320 A * 12/1989 Long ..... A42B 3/226 2/424
4,947,490 A * 8/1990 Hayden ..... A42B 3/20 2/424
5,095,552 A * 3/1992 Parkinson ..... A42B 3/20 2/424
5,226,180 A * 7/1993 Leach ..... A42B 1/08 2/171.1
5,502,843 A * 4/1996 Strickland ..... A42B 3/20 2/424
5,613,655 A * 3/1997 Marion ..... F16L 3/2235 24/339
5,675,875 A * 10/1997 Servatius ..... A42B 3/20 2/424
5,832,541 A * 11/1998 Rock ..... A42B 3/20 2/424
6,047,400 A * 4/2000 Spencer ..... A42B 3/20 2/424
6,079,053 A * 6/2000 Clover, Jr. ..... A42B 3/20 2/424
6,154,889 A * 12/2000 Moore, III ..... A42B 3/06 2/411
6,359,602 B1 * 3/2002 Amafuji ..... G02B 27/0172 345/8
6,381,760 B1 * 5/2002 Lampe ..... A42B 3/00 2/414
7,900,279 B2 * 3/2011 Kraemer ..... A42B 3/205 2/410
8,146,178 B2 * 4/2012 Maddux ..... A42B 3/20 2/424
8,528,118 B2 * 9/2013 Ide ..... A42B 3/08 2/425
8,640,267 B1 * 2/2014 Cohen ..... A42B 3/063 2/411
8,756,771 B1 * 6/2014 Moreau ..... F16B 2/10 24/517
8,813,269 B2 * 8/2014 Bologna ..... A42B 3/20 2/425
8,819,871 B2 * 9/2014 Maddux ..... A42B 3/20 2/424
9,027,163 B1 * 5/2015 Schmidt ..... A63B 71/10 2/424
9,155,924 B1 * 10/2015 Grove ..... A62B 18/04
9,265,297 B2 * 2/2016 Warmouth ..... A42B 3/328
9,826,793 B2 * 11/2017 Miller ..... A42B 3/288
9,961,953 B1 * 5/2018 VanHoutin ..... A42B 3/328
2007/0050892 A1 * 3/2007 Charles ..... A61F 9/06 2/410
2011/0277221 A1 * 11/2011 Ide ..... A42B 3/08 2/414
2012/0011686 A1 * 1/2012 Duong ..... A42B 3/20 24/489
2013/0111654 A1 * 5/2013 Gorsen ..... A42B 3/205 2/421
2015/0223546 A1 * 8/2015 Cohen ..... A42B 3/063 2/412
2016/0021968 A1 * 1/2016 Warmouth ..... A42B 3/328 24/517
2016/0029733 A1 * 2/2016 Kovarik ..... A42B 3/20 2/411

* cited by examiner

HELMET WITH FACEGUARD SYSTEM

FIELD OF INVENTION

The present invention relates generally to a helmet with a faceguard for use in diamond sports such as baseball and softball or the like. More particularly, the present invention relates to a system utilizing a spacer to allow a uniformly sized wire faceguard to fit different helmet sizes.

BACKGROUND OF INVENTION

Most batting helmets include or can be used with a faceguard. A faceguard may take the form of a wire guard, and will be referred to hereinafter as a "wire guard" for ease of reference, although it should be noted that other types of faceguards are also included. However, different helmet sizes are manufactured for different age ranges. Even within age ranges, different helmet sizes are often needed simply to accommodate the many possible head sizes of players. Therefore, there are generally several different helmet sizes for a particular model. To create different helmet sizes, two different techniques are used. In the first, different shells with different actual sizes are manufactured. In the second, a single larger shell size is manufactured, and different amounts of padding are added inside to create different "sizes."

Each helmet size will generally have an optional or included wire guard. Manufacturers that produce a different size shell for each helmet size also need to create a specific wire guard size for each size shell. This is illustrated in FIG. 1, which shows a prior art helmet 100. The helmet 100 includes a shell 105, which has attachment points 110A and 100B on either side. In this case, the prior art shell 105 is a smaller shell. The helmet 100 also includes a wire guard 115, which also includes corresponding attachment points 120A, 120B on either side. However, as shown in FIG. 1, if the wire guard 115 is made for a larger helmet shell, it will not fit onto the smaller shell 105. Consequently, each helmet shell size needs its own corresponding wire guard. The number of SKUs thereby increases because each wire guard needs its own SKU.

Alternatively, manufacturers that use one shell for all sizes do not need to manufacture different wire guards for each helmet size. A single wire guard size fits all of their helmet sizes, because all of their helmet sizes utilize the same shell. However, the use of a single, larger shell size creates its own problems. As noted above, increasing amounts of foam in the shell are used to create "smaller" sizes. Thus, the smaller sizes actually include the most material, which leads to the highest cost. Retailers and consumes generally feel smaller size helmets should be the same or cheaper than the larger size helmets, resulting in the manufacturer having a lower margin.

Thus, there is a continuing need for improved helmet and faceguard system that would allow a single wire guard to fit generally any corresponding shell size.

SUMMARY OF THE INVENTION

In an example embodiment, a helmet comprising a shell, a wire guard, at least one spacer, and at least one fastener. The shell has at least one attachment portion which includes an outer surface. The wire guard has at least one attachment portion corresponding to the at least one attachment portion of the shell. The attachment portion of the wire guard includes an inner surface. Each spacer has an outer surface corresponding to the inner surface of a the attachment portion of the wire guard. Each spacer also has an inner surface corresponding to the outer surface of the attachment portion of the shell. The at least one fastener engages each spacer with the corresponding attachment portions of the shell and wire guard.

In another embodiment, a helmet system comprises a first shell having a first size, and a second shell having a second size. The first size is larger than the second size. The system also includes a wire guard for engagement with the first and second shells. At least one first spacer is configured to fit between an engagement portion of the wire guard and the first shell. At least one second spacer is configured to fit between an engagement of the wire guard and the second shell. The first spacer is larger than the second spacer.

Additionally, the helmet system may include a third shell having a third size which is larger than the first and second sizes. The wire guard may be selectively engagable with the third shell without the use of a spacer.

DESCRIPTION OF THE DRAWINGS

For a better understanding of the various embodiments of the present invention, reference may be made to the accompanying drawings in which.

Figure 1:
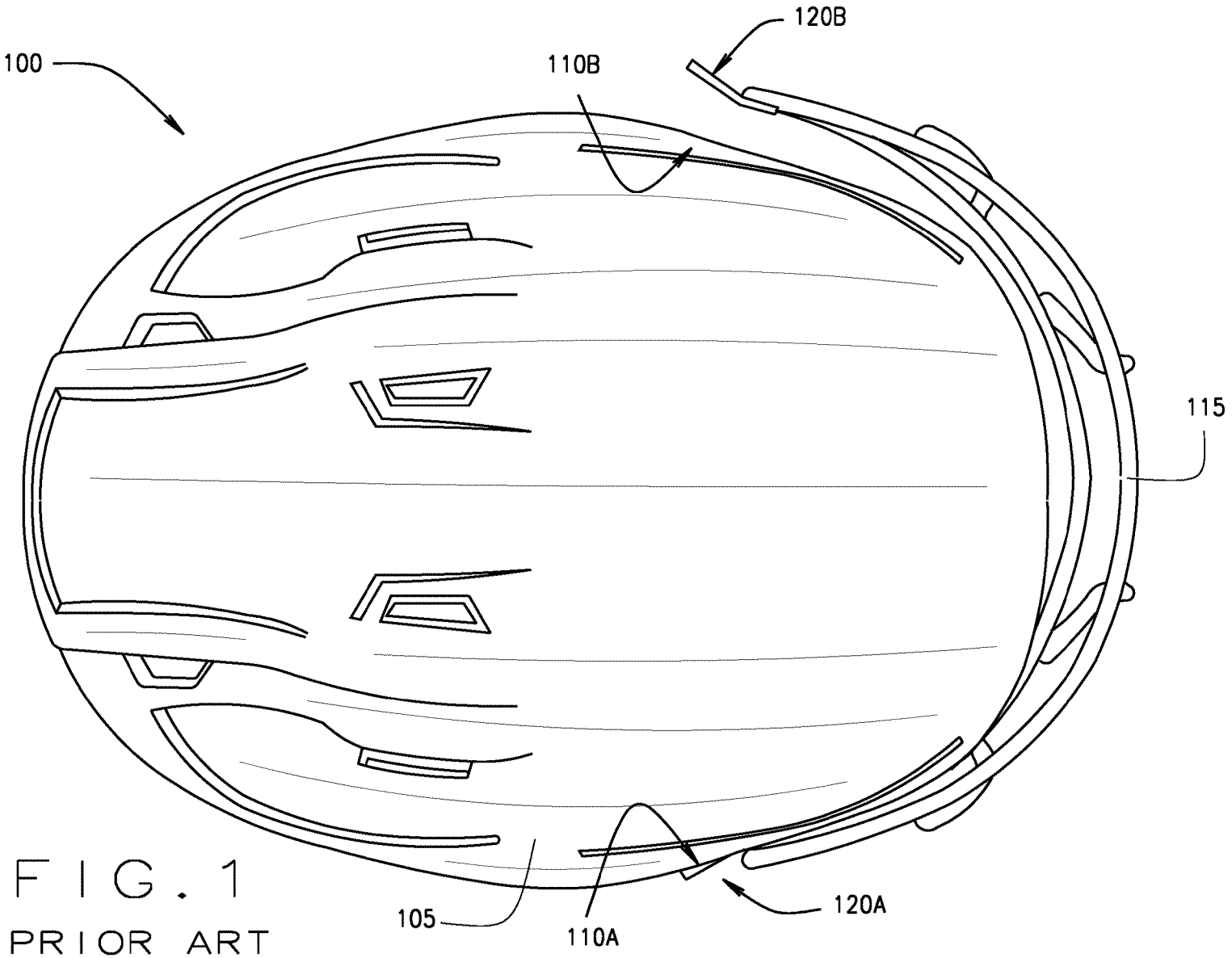
FIG. 1 PRIOR ART
FIG. 1 is a top plan view of a prior art helmet shell with a ill-fitting wire guard.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2A:
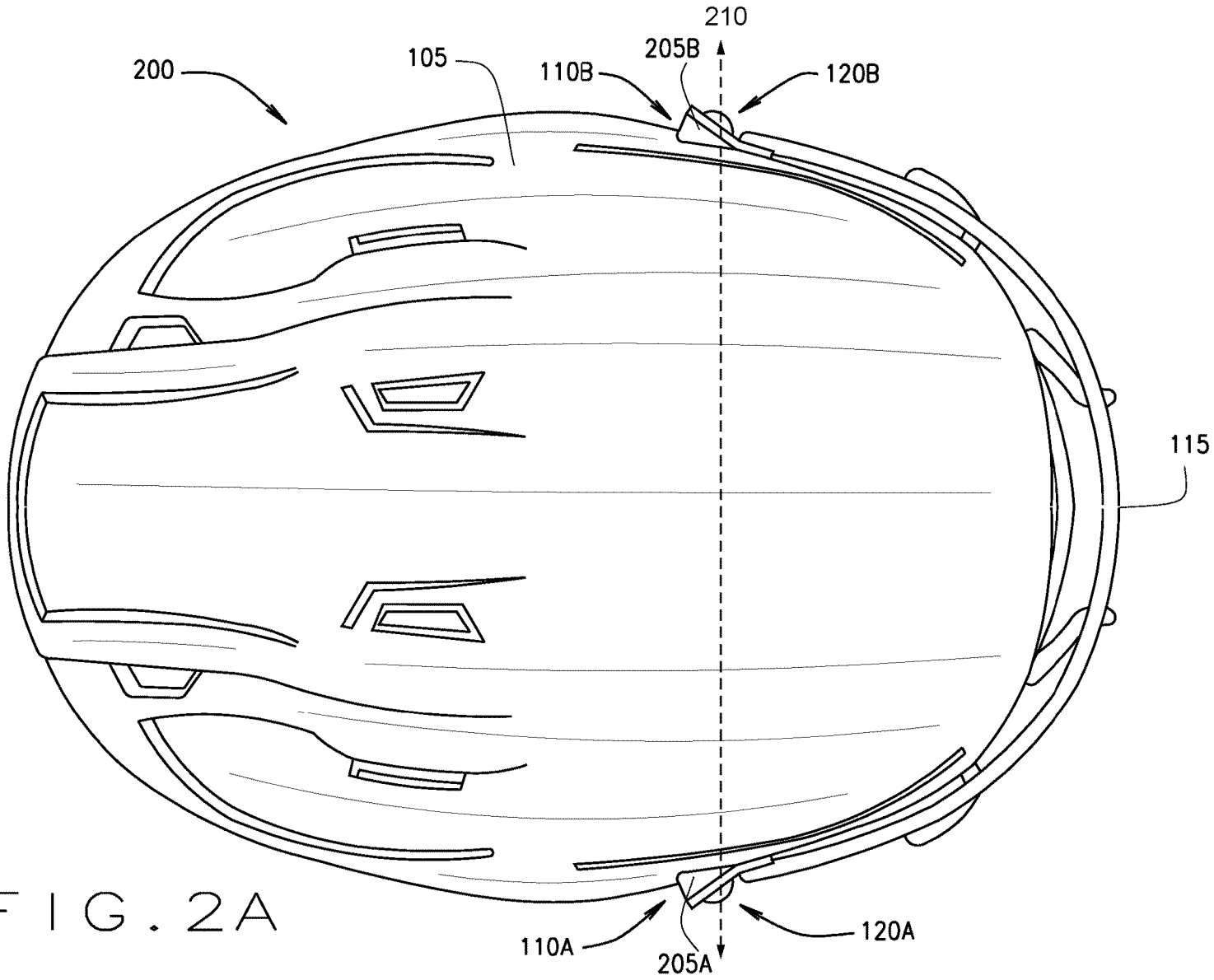
FIG. 2A is a top plan view of an example embodiment of a helmet system.
Figure 2B:
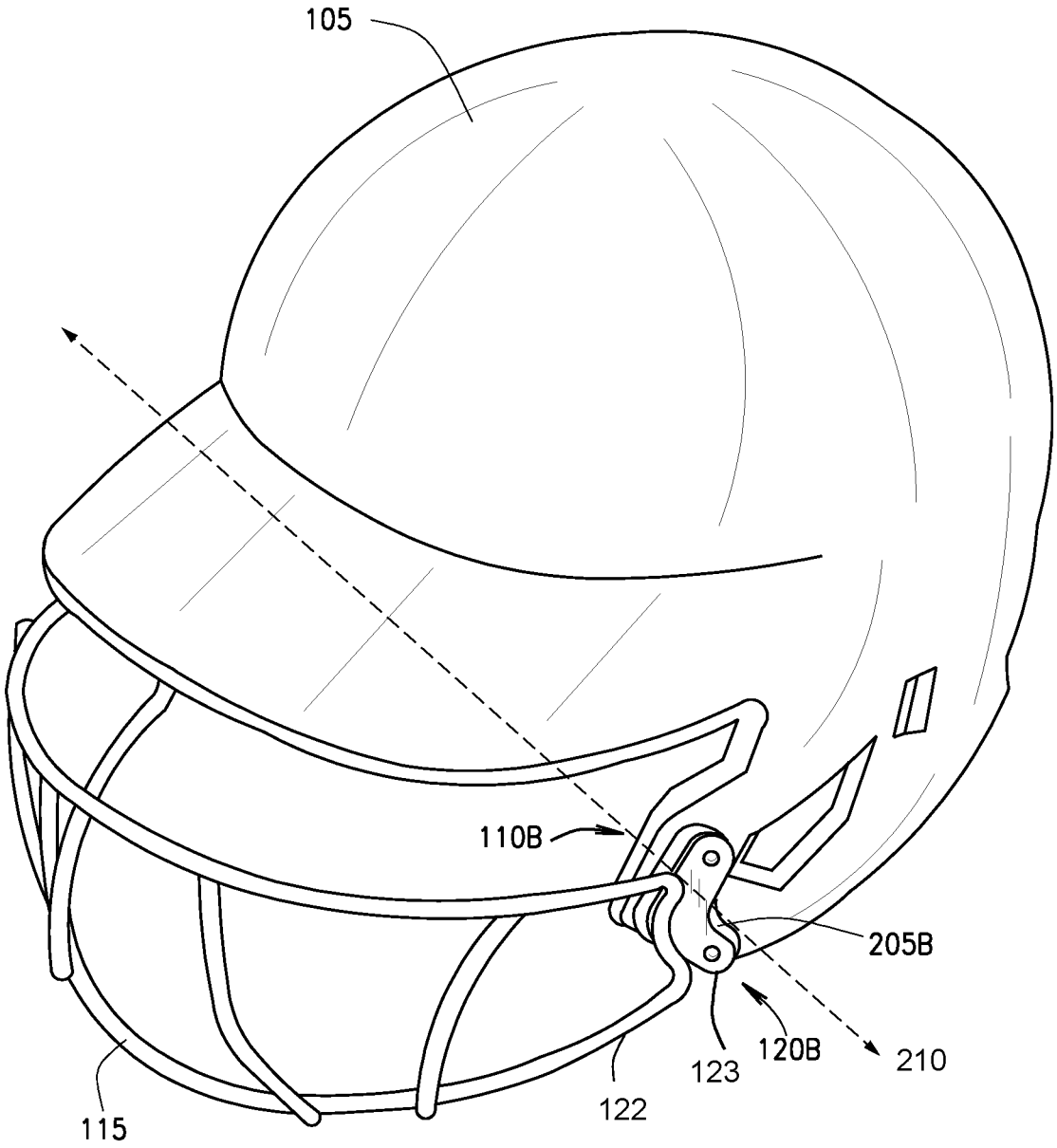
FIG. 2B is a perspective view of the example embodiment of FIG. 2A.

Referring to the drawings, FIGS. 2A and 2B illustrate a helmet system 200. Specifically, the smaller helmet shell 105 is shown as connected to the larger wire guard 115. As will be understood, the shell 105 and wire guard 115 may take on any desirable shape, design, contour, or the like. Shell 105 and wire guard 115 may be made out of any desirable material. On each side, a spacer 205A, 205B is positioned between the respective attachment point 110A, 110B of the shell 105 and the respective attachment point 120A, 120B of the wire guard 115. The wire guard 115 generally includes each of a wire portion 122 and an adaptor member 123. The adaptor member 123 includes the attachment points 120A, 120B. It is noted that only a single spacer 205 may be used on one side or the other, although this would cause an offset of the wire guard 115 relative to the shell 105. An axis 210 is provided that extends through opposing side portions of the helmet. As illustrated in FIGS. 2A and 2B, along the axis 210, the attachment points 110A, 110B of the shell 105 and the attachment points 120A, 120B of the wire guard 115 are distanced from one another by the spacers 205A and 205B, respectively. Further, the attachment points 110A, 110B of the shell 105 and the wire guard 115 itself are distanced from one another by the spacers 205A and 205B, respectively along the axis 210.

Figure 3:
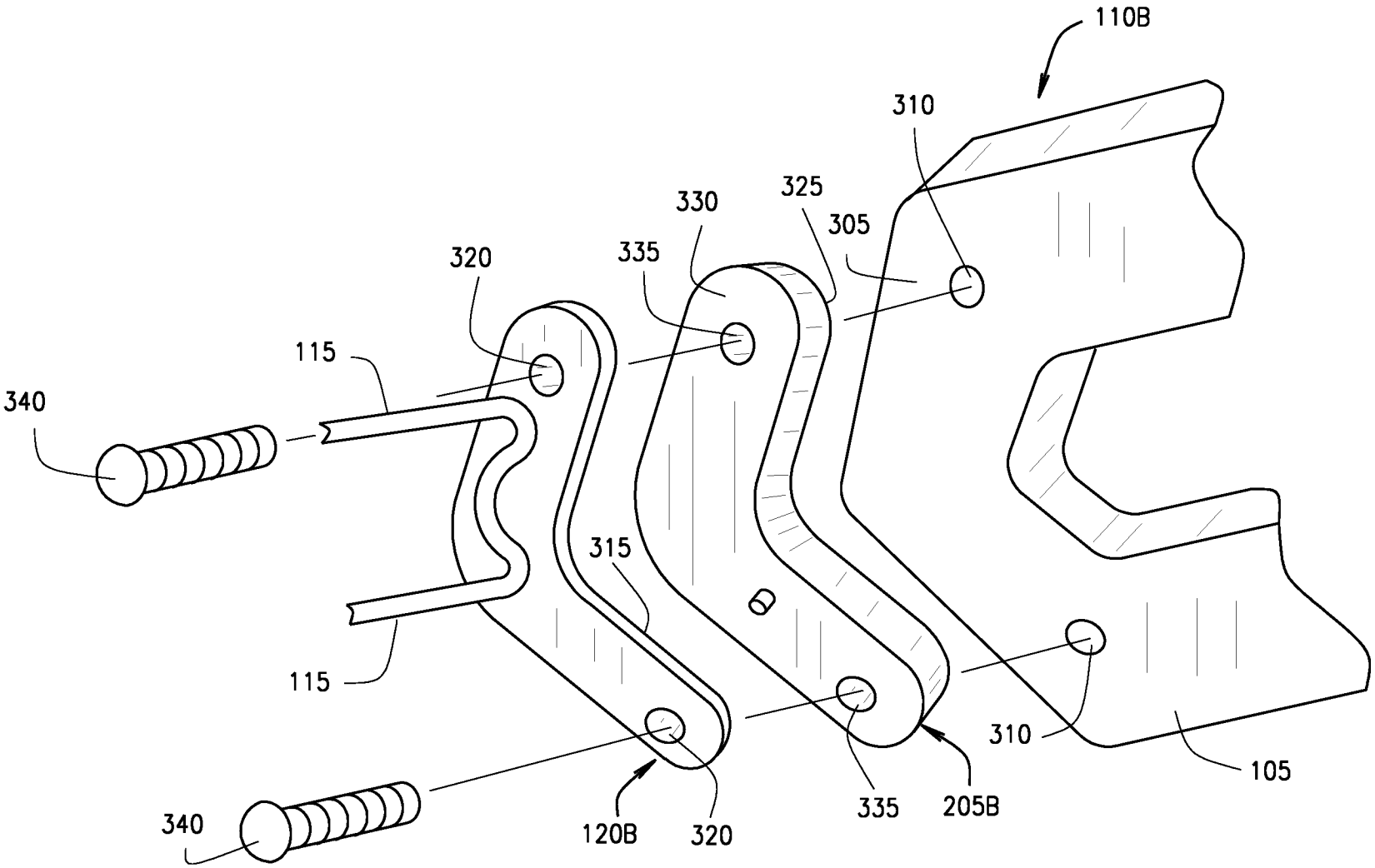
FIG. 3. is an exploded perspective view of an attachment of a wire guard to a helmet according to an example embodiment.

To better illustrate the engagement between the shell 105, wire guard 115, and a spacer 205, FIG. 3 shows an exploded view thereof. An attachment point 110 of shell 105 may generally take any desirable shape, and have any desirable contours. As shown, shell 105 includes an outer surface 305 at the illustrated attachment point 110, along with two through-holes 310. Similarly, the corresponding attachment point 120 of the wire guard 115 includes an inner surface 315, along with two through-holes 320 corresponding to the through-holes 310 of the shell 105.

Positioned therebetween is a spacer 205. The spacer 205 has an inner surface 325 that preferably corresponds in dimension and contour to engage with and mirror the outer surface 305 of the attachment point 110 of the shell 105. Similarly, the spacer 205 has an outer surface 330 that preferably corresponds in dimension and contour to engage with and mirror the inner surface 315 of the attachment point 120 of the wire guard 115. Spacer 205 preferably includes two through-holes 335 corresponding to the through-holes 310 of the shell 105 and the through-holes 320 of the wire guard 115.

A respective fastener 340 extends through each of the sets of through-holes 310, 320, 335 to affix the wire guard 115 and spacer 205 to the shell 105. Each fastener 340 may engage with a nut or similar component to secure the fastener 340 in place. However, it will be recognized that through-holes 310 in shell 105 may not extend all the way through the shell 105, such that they act as a sort of nut. It will also be recognized that different numbers and positions of through holes 310, 320, 335 may be used. Also, rather than through-holes 310, 320, 335 and fasteners 340, other fastening mechanisms may be used. As non-limiting examples, snaps, detents, buckles, and the like may all be used without altering the spirit hereof. For ease of reference, all such fastening mechanisms are referred to herein as "fasteners" for ease of reference.

Figure 4:
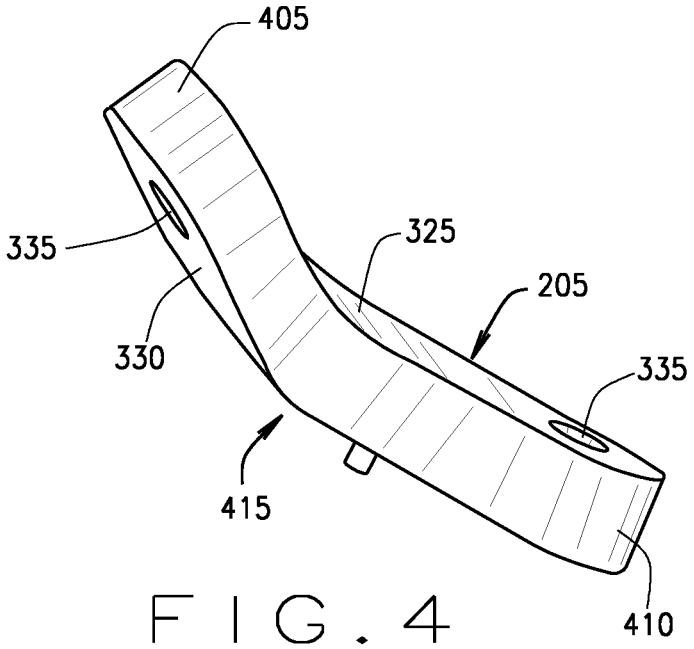
FIG. 4 is a perspective view of a spacer according to an example embodiment.
Figure 5:
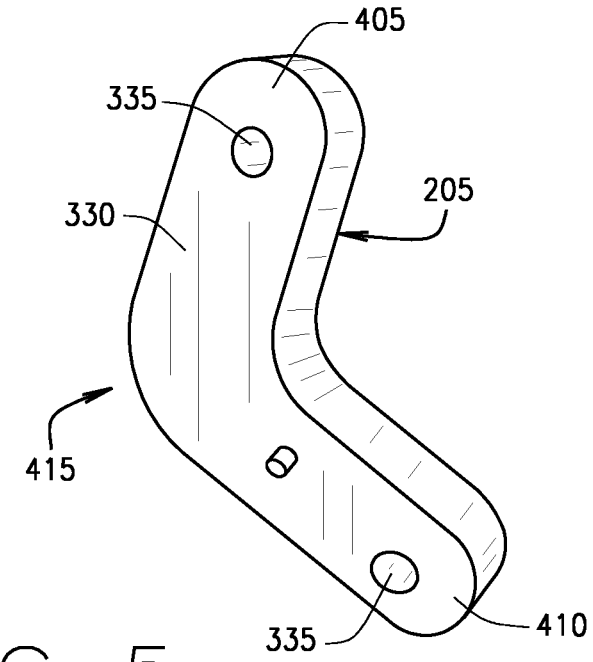
FIG. 5 is another perspective view of the spacer of FIG. 4.

FIGS. 4 and 5 illustrate two additional views of an example embodiment of a spacer 205. As can be seen, in the example embodiment show, the spacer 205 may have a generally angled shape, having arms 405 and 410 that extend at an angle from one another from a vertex 415. As can be seen in FIGS. 4 and 5, the arms 405, 410 may be angled relative to one another in one or more than one plane. FIG. 4 illustrates an angle or curvature in which the inner surface 325 is concave, whereas FIG. 5 illustrates an angle or curvature along a longitudinal plane of the spacer 205. Such angles, curves, and the like preferably follow the respective contours of the relevant shell 105 and wire guard 115, thereby allowing the spacer 205 to slot in therebetween.

As will be understood, different spacers 205 would be used to allow a uniformly sized wire guard 115 to fit onto different sizes of shells 105. Rather than manufacture a single large shell 105 and wire guard 115 size (and then adding increasing amounts of padding to accommodate smaller head sizes), only a single wire guard 115 could be manufactured, and different spacers 205 would be used to allow that single wire guard 115 to fit with different sizes of shells 105. Different spacers 205 are generally much less expensive to manufacture than different wire guards 115. The largest helmet shell 105 in a product line may fit the wire guard 115 without any spacers 205, while increasingly smaller shells 105 would utilize correspondingly larger spacers 205.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A helmet system comprising:

a first shell having a first shell attachment portion, the first shell attachment portion having an outer surface, wherein said first shell has a first size;

a second shell having a second shell attachment portion having an outer surface; wherein said second shell has a second size larger than the first size;

a wire guard comprising an adaptor member and a wire portion, the wire portion coupled to the adaptor member, the adaptor member of the wire guard having a wire guard attachment portion corresponding to the first shell attachment portion and the second shell attachment portion, said wire guard attachment portion including an inner surface;

a spacer having an outer surface corresponding to the inner surface of the wire guard attachment portion and an inner surface corresponding to the outer surface of the first shell attachment portion;

a fastener;

a first axis that extends through opposing side portions of the first shell; and a second axis that extends through opposing side portions of the second shell;

wherein when the first shell is coupled to the wire guard, the fastener fastens the spacer between the first shell attachment portion and the wire guard attachment portion along the first axis, such that the spacer is sandwiched between the outer surface of the first shell attachment portion and the inner surface of the wire guard attachment portion, and such that the first shell attachment portion and the wire guard attachment portion are distanced along the first axis from one another by the spacer, and wherein when the second shell is coupled to the wire guard, the fastener directly fastens the second shell attachment portion to the wire guard attachment portion along the second axis, such that the outer surface of the second shell attachment portion directly engages the inner surface of the wire guard attachment portion.

2. The helmet system of claim 1 wherein the first shell attachment portion includes two opposing attachment points, wherein the wire guard attachment portion includes two opposing attachment points, and wherein the spacer is a first spacer and the helmet system further includes a second spacer, such that when the first shell is coupled to the wire guard, the first spacer is fastened between one of the two opposing attachment points of the first shell and a corresponding one of the two opposing attachment points of the wire guard, and the second spacer is fastened between the other of the two opposing attachment points of the first shell and the other of the two opposing attachment points of the wire guard.

3. The helmet system of claim 1 wherein the at least one attachment portion of the the first shell attachment portion includes two opposing attachment points, wherein the wire guard attachment portion includes two opposing attachment points, wherein the spacer is fastened between one of the two opposing attachment points of the first shell and a corresponding one of the two opposing attachment points of the wire guard, and wherein the other of the two opposing attachment points of the first shell and the other of the two opposing attachment points of the wire guard are engaged directly with one another via the fastener, thereby creating an offset of the wire guard relative to the first shell.

* * * * *